US005419941A

United States Patent [19]

Noone et al.

[11] Patent Number: 5,419,941

[45] Date of Patent: May 30, 1995

[54] HIP OR RIDGE SHINGLE AND METHOD OF MAKING

[75] Inventors: Michael J. Noone, Wayne; Kermit E. Stahl, North Wales, both of Pa.

[73] Assignee: CertainTeed Corporation, Valley Forge, Pa.

[21] Appl. No.: 899,331

[22] Filed: Jun. 16, 1992

[51] Int. Cl.[6] ..... D06N 7/04; B61D 17/14; E04D 1/00

[52] U.S. Cl. ..... 428/141; 428/151; 52/42; 52/43; 52/49; 52/199; 52/540

[58] Field of Search ..... 428/141, 151; 52/42, 52/43, 49, 199, 540

[56] References Cited

U.S. PATENT DOCUMENTS

| | | | |
|---|---|---|---|
| 1,795,913 | 3/1931 | Weaver | 52/513 |
| 1,989,554 | 5/1931 | Kirschbraun et al. | 108/7 |
| 3,252,257 | 5/1966 | Price et al. | 52/420 |
| 3,921,358 | 11/1975 | Bettoli | 52/314 |
| 4,717,614 | 1/1988 | Bondoc et al. | 428/143 |
| 4,920,721 | 5/1990 | Pressutti et al. | 52/542 |

*Primary Examiner*—George F. Lesmes
*Assistant Examiner*—Kathryne E. Shelborne
*Attorney, Agent, or Firm*—Paul & Paul

[57] ABSTRACT

A shingle is provided that is especially adapted for application to hips or ridges of a roof. In a preferred embodiment, the shingle is a laminated multi-layer shingle, bent or curled into a preformed shape that is reasonably close to the shape that it will have in the installed condition. The shingle layers are connected together in more than one zone, or in one large zone after sliding relative to one another as the shingle is bent or curled. Preferably, such connection is by means of an adhesive.

2 Claims, 1 Drawing Sheet

HIP OR RIDGE SHINGLE AND METHOD OF MAKING

BACKGROUND OF THE INVENTION

Figure 1:
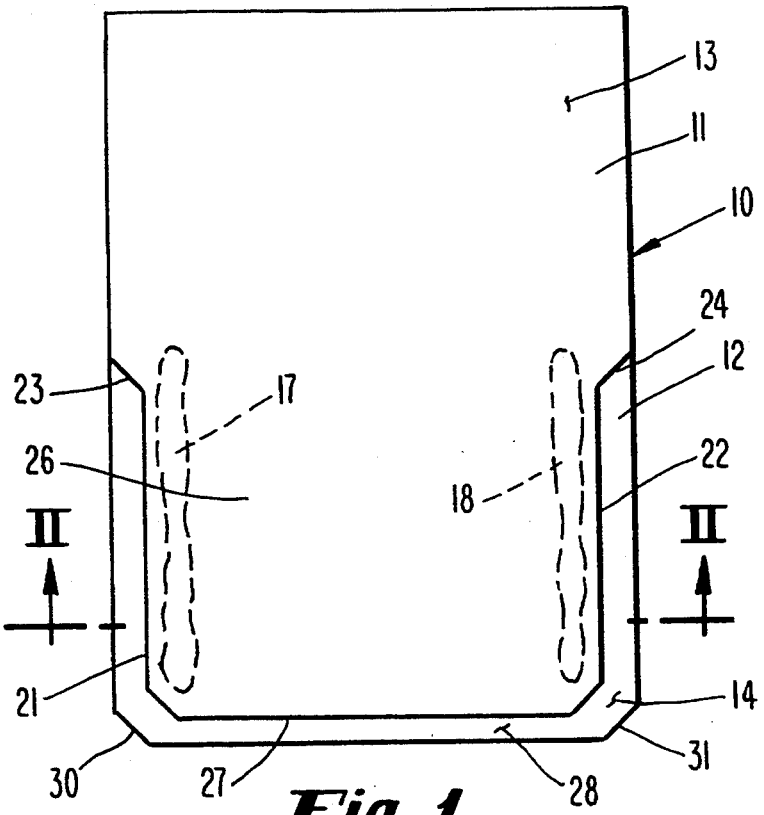

In the art of shingle manufacture and use, it is commonplace that shingles are laid up onto a roof in courses or rows, generally with successive rows being staggered relative to each other. As courses approach the apex of a roof, commonly referred to as the "ridge", and generally from each side of the ridge, the shingling of the ridge itself has generally required separate treatment. Similarly, in roofing other surfaces of roofs, such as dormers, or even different types of roofs, there are places where different planes come together that are not ridges, but are called "hips". Hips can occur, for example, at the lines of intersection of the various planes of a pyramid-shaped structure. In each of these circumstances, whether it involves shingling a ridge or shingling a hip, it is necessary that the shingle be bent or curled around the hip or ridge, partially covering each of the planes that make up the hip or ridge.

Conventionally, therefore, the shingles that effect such covering are called "hip or ridge" shingles. Hip or ridge shingles have often been prepared on the building site by roofers, simply by cutting a portion of a conventional shingle. Typically, if a roof is being covered with shingles, particularly three-tab or four-tab shingles, the roofer will cut a shingle through the headlap portion, continuing the separation provided by the precut slots between adjacent tabs of a shingle, thereby yielding hip or ridge shingles each the width of a single tab, and having a lower tab portion and an upper headlap portion. The hip or ridge would then be conventionally covered by laying up such shingles such that the tab portions are visible, with each next-applied shingle having its tab portion covering the headlap portion of a previously applied shingle.

As styles in general have changed, particularly to provide roofs with different aesthetic effects, but often to provide roofs with improved protection from the elements, the use of laminated multi-layer shingles has increased. A multi-layer shingle in the art is a shingle that is comprised of at least two complete shingle layers; that is, each shingle layer as a minimum would have a base mat generally either of rag or fiberglass construction, with asphaltic material applied, generally to both sides with the mat embedded in the asphaltic material, and a covering of granules, at least on the upper surface, but also with a coating of another substance, perhaps mica, on the lower surface. The asphaltic material is generally a material having a bitumin base. Such complete layers of shingle material can have other laminae as components of their interior construction, but will at least generally have a base mat, a layer of asphaltic material, and a layer of granules. In constructing a laminated shingle, two or more such layers of complete shingle material are connected together, generally by means of an adhesive disposed between the layers, which adhesive will often generally also be an asphaltic material.

In laminating shingles together, the adhesive between adjacent layers can cover the entire superimposed surfaces, or can be applied in spaced-apart locations between the superimposed surfaces of the shingle layers, so that a given multi-layer shingle can be applied in a single shingling application, much the same way as one would apply a single layer shingle to a roof.

In endeavoring to use cut-up tab portions of a multi-layer shingle as hip and ridge shingles, it has been found that the bending or curling of such shingles can lead to cracking or wrinkling of at least one of the layers of the multi-layer shingle.

One effort to solve the problem has resulted in making special hip or ridge shingles rather than cutting them on the building site from the regular roofing shingles. Such special hip or ridge shingles have been made with a line of adhesive connecting the upper and lower layers and running vertical on the shingle so that when the shingle is bent around a hip or ridge, the line of adhesive will be more or less aligned with the hip or ridge, and with portions of the hip or ridge shingle on opposite sides of the bend then being secured to the surfaces of the roof on opposite sides of the hip or ridge. However, because such a shingle is bent, the uncovered tab portions of the upper layer of shingle may tend to stick up into the air, presenting risks of being caught by wind and ripped away from the roof. In order to overcome that particular problem, an adhesive can be applied at the site, to secure such tab portions of upper layers of the shingles on opposite sides of the hip or ridge, down into contact with the shingle's lower layer. Such a solution to the problem of wrinkling or cracking of these shingles, however, requires that additional labor-intensive procedure; namely, on-site sealing with an adhesive.

Furthermore, in applying hip or ridge shingles in general, care must be taken to provide the proper spacing for the visible portions of the shingles; i.e., to allow just the right amount of tab portion of the shingle to be exposed, without the benefit of being guided by a full course of shingles, as is present when applying full size shingles by courses to sloped surfaces of a roof.

SUMMARY OF THE INVENTION

The present invention addresses the problems set forth above by providing a laminated multi-layer shingle, in which adhesive is applied between the layers and the layers are bent or curled so that the layers slide relative to each other as the shingle is bent or curled and the three-dimensional bent or curled shape is held until the adhesive sets, maintaining the preformed shape as the shingle is applied to cover a hip or ridge.

OBJECTS OF THE INVENTION

Accordingly, it is a primary object of the present invention to provide a novel multi-layer laminated hip or ridge shingle bent or curled to fit around a hip or ridge, and adhered together to be preformed, and a method of making the shingle.

Other objects and advantages of the present invention will be readily apparent upon a reading of the following brief descriptions of the drawing figures, detailed descriptions of the preferred embodiment and the appended claims.

BRIEF DESCRIPTIONS OF THE DRAWING FIGURES

FIG. 1 is a top plan view of a laminated multi-layer hip or ridge shingle, with adhesive shown in dotted lines for connecting the layers together.

Figure 2:
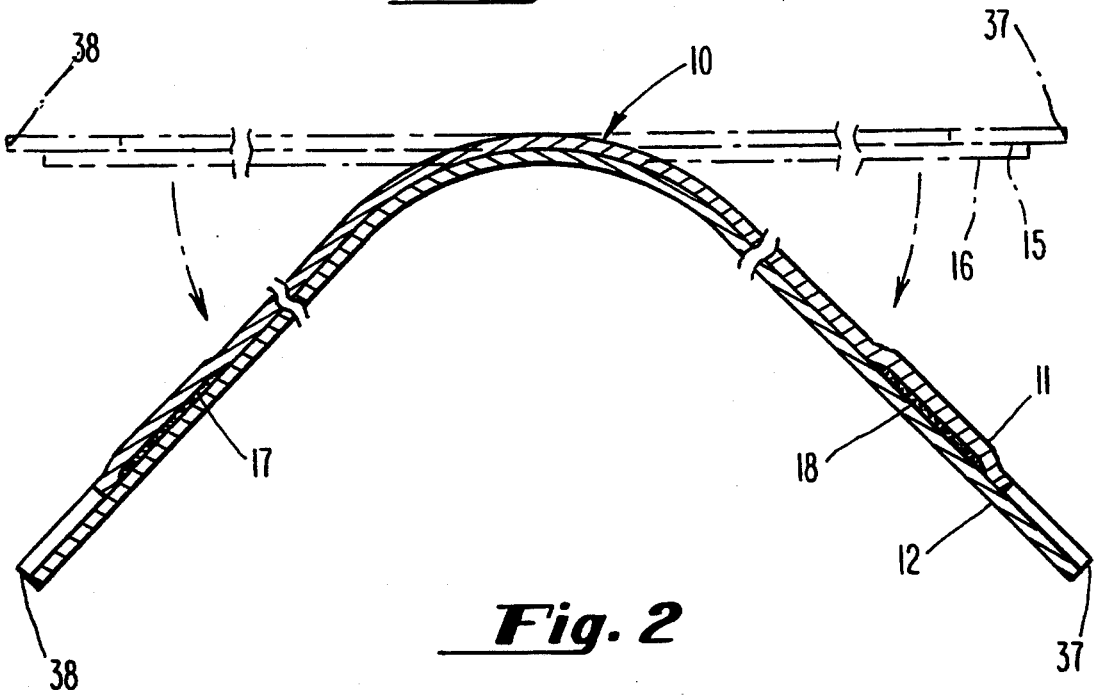

FIG. 2 is an enlarged fragmentary horizontal transverse sectional view of the shingle of FIG. 1, taken generally along the line II—II of FIG. 1, and first in phantom in flat form and wherein the shingle in full lines has been bent or curled into the approximate shape in which it will be applied to a roof hip or ridge with the shape then being held until the adhesive sets to preform the shingle's shape.

DETAILED DESCRIPTIONS OF THE PREFERRED EMBODIMENTS

Referring now to the drawings in detail, reference is first made to FIG. 1, wherein a laminated multi-layer shingle 10 is illustrated in the form of a hip-and-ridge shingle, as comprising an upper layer 11 and a lower layer 12, each of complete shingle material. That is, each layer 11 and 12 is comprised of a base mat covered, preferably by being embedded in an asphaltic "bitumin" material and having a layer of granules on each upper surface 13, 14. Lower surfaces 15, 16 will also generally be provided with a layer of finer granular material, such as mica or the like applied thereto. The upper and lower layers 11, 12 are brought together with vertical strips 17, 18 of adhesive material applied to either the under surface 15 of layer 11 or to the upper surface 14 of layer 12, or both as illustrated in dotted line at the left of FIG. 1, such that the adhesive is in sandwiched relation between the layers. The adhesive 17, 18 is preferably of an asphaltic material, and will be allowed to cure or set and preferably become dry, connecting the layers 11, 12 together in the bent or curled shape shown in full lines in FIG. 2.

It will be noted that the upper layer 11 of the shingle 10 has a cut-back portion 21 on the left side, and another cut-back portion 22 on the right side, with such cuts being generally vertically disposed and terminating in sloped lines 23, 24, respectively, at the junction of the upper or headlap portion 25 of the shingle 10, with the tab portion 26, thereof. It will also be noted that the lower edge of the upper shingle layer 10 has a cut-back portion 27, leaving a U-shaped zone 28 of the tab portion of the lower shingle 12 framing the tab portion of the upper shingle 11, as shown in FIG. 1.

It will further be noted that the sloped lines 23, 24, formed at said cut-back portions are configured the same as the lower left and right corners 30, 31 of the lower layer 12, to be respectively parallel therewith.

As the adhesive 17, 18 sets while the shingle 10 is held in the full line bent or curled configuration shown in FIG. 2, the adhesive 18 is enabled to connect together the layers 11 and 12 in the zone of each in which the adhesive is present, permanently holding the preformed shape. By reference to the phantom and full line illustrations of FIGS. 2, it will be seen that the right and left edges 37 and 38 of the upper shingle layer 11 move leftward and rightward, respectively, as the layers 11 and 12 are curled or bent, from the position illustrated in phantom in FIG. 2, to that illustrated in full line configuration of FIG. 2, to allow take-up of the material to accommodate the curling or bending.

It will thus be seen that, in the installed condition of the shingle 10, the tab portion 26 of the shingle will have left and right sides of its upper layer 11, securely connected to the corresponding left and right sides of the underlying shingle layer 12, at both zones 17 and 18, in order to hold that tab portion down, tightly against the lower shingle layer 12.

It will be apparent from the foregoing that various modifications may be made in the details of construction, as well as in the use and operation of shingles in accordance with the present invention, all within the spirit and scope of the invention as claimed. For example, hip and ridge shingles may be used in accordance with the present invention, in a reverse bend situation, so as to accommodate shingling valleys formed where different planes of roof come together. Moreover, the sliding aspect of the present invention between upper and lower layers of a multi-layer shingle is applicable to shingles other than hip and ridge shingles; for example, with standard multi-layer shingles, wherever tight bends or turns are to be used for such shingles. In this regard, in shingling over arches of tight dimension, bulges, etc., it will be understood that the present invention is applicable for full size shingles, multi-tab shingles, etc. It will also be understood that a plurality of adhesive zones may be utilized in accordance with the present invention, and that such adhesive zones need not be unbroken, in that they could be dots or spots of adhesive, if desired, or even completely or substantially cover the shingle layers where they are in face-to-face engagement. It will also be understood that such adhesive zones could be multiple throughout the layers of overlap of the shingle, in either or both of the headlap and/or tab portion, along either or both sides, along the bottom of the overlying shingle portions, etc. It will also be understood that different types of adhesive other than asphaltic adhesives may be used with the present invention, and even other types of connections between shingle layers.

It will further be understood that while the slanted edges 23, 30 constructed to be parallel to each other for aligning and locating one shingle relative to another are desirable, that other forms of locating and indicia may also be utilized, to effect proper placement of one hip and ridge shingle relative to another.

Accordingly, it will be seen that the present invention is as set forth in the appended claims.

We claim:

1. A composite laminated shingle adapted to be applied to a roof comprising:

(a) a first layer of shingle;

(b) a second layer of shingle in surface-to-surface engagement with said first layer of shingle;

(c) wherein each said layer is comprised of a base mat with asphaltic material applied thereto and a covering of granules on one surface thereof; and (d) a curable adhesive located between said layers of shingle, sandwiched therebetween;

with said layers of shingle comprising a bent three-dimensional configuration held in said configuration by the curing of said adhesive, prior to application of the laminated shingle to a roof, wherein the adhesive is disposed between the layers of shingle at locations at opposite sides of the bend.

2. The shingle of claim 1, wherein the composite laminated shingle is a hip and ridge shingle having a headlap portion and a tab portion and wherein the curable adhesive that is disposed between the layers of shingle at locations on opposite sides of the bend, is disposed in the tab portions thereof.

* * * * *